US008215932B2

(12) United States Patent
O'Brien, II

(10) Patent No.: US 8,215,932 B2
(45) Date of Patent: Jul. 10, 2012

(54) LONG LIFE TELESCOPING GEAR PUMPS AND MOTORS

(75) Inventor: James A. O'Brien, II, LaSalle, MI (US)

(73) Assignee: Limo-Reid, Inc., Deerfield, MI (US)

( * ) Notice: Subject to any disclaimer, the term of this patent is extended or adjusted under 35 U.S.C. 154(b) by 718 days.

(21) Appl. No.: 11/851,482

(22) Filed: Sep. 7, 2007

(65) Prior Publication Data

US 2008/0038136 A1 Feb. 14, 2008

Related U.S. Application Data

(63) Continuation-in-part of application No. 11/844,416, filed on Aug. 24, 2007, now Pat. No. 7,588,431, which is a continuation of application No. 11/359,728, filed on Feb. 22, 2006, now Pat. No. 7,281,376, which is a continuation-in-part of application No. 11/101,837, filed on Apr. 8, 2005, now Pat. No. 7,179,070.

(60) Provisional application No. 60/824,981, filed on Sep. 8, 2006, provisional application No. 60/655,221, filed on Feb. 22, 2005, provisional application No. 60/560,897, filed on Apr. 9, 2004.

(51) Int. Cl.
*F03C 2/00* (2006.01)
*F03C 4/00* (2006.01)

(52) U.S. Cl. ..... 418/21; 418/128; 418/170; 418/171; 418/206.1; 418/206.6

(58) Field of Classification Search ..... 418/19, 418/21, 24, 28, 29, 116, 128, 129, 149, 170, 418/171, 206.1, 206.6, 206.7; 417/310
See application file for complete search history.

(56) References Cited

U.S. PATENT DOCUMENTS

| | | | | |
|---|---|---|---|---|
| 60,365 | A | 12/1866 | Hardy | |
| 815,522 | A | 3/1906 | Fraser | |
| 1,773,211 | A * | 8/1930 | Wilsey | 418/9 |
| 1,853,430 | A | 4/1932 | Jensen | |
| 2,293,126 | A | 8/1942 | Fersing | |
| 2,484,789 | A | 10/1949 | Hill et al. | |
| 2,684,636 | A | 7/1954 | Heldenbrand | |
| 2,754,765 | A | 7/1956 | Joy | |
| 3,007,418 | A | 11/1961 | Brundage | |
| 3,110,265 | A | 11/1963 | Miller | |
| 3,549,209 | A | 12/1970 | Moericke | |
| 3,588,295 | A | 6/1971 | Burk | |
| 3,687,578 | A * | 8/1972 | White et al. | 418/21 |

(Continued)

FOREIGN PATENT DOCUMENTS

GB 2265945 A 10/1993

(Continued)

*Primary Examiner* — Theresa Trieu
(74) *Attorney, Agent, or Firm* — Fraser Clemens Martin & Miller LLC; William J. Clemens

(57) ABSTRACT

A telescoping gear pump comprises a bolt, a Bellville washer, a wear plate, a seal housing, a seal spring, a spur gear including a wear lobe, a seal ring and a case drain path, a shaft, a ring gear including a wear lobe, seal ring, and a case drain path, seal, a bolt assembly including a Bellville washer and bolt, and a pressure plate. The assembly provides pressure to a fluid to maintain a seal within a telescoping pump/motor during operation. The wear lobe reduces wear while maintaining fluid pressure.

14 Claims, 13 Drawing Sheets

U.S. PATENT DOCUMENTS

| | | | | | |
|---|---|---|---|---|---|
| 3,805,526 | A | | 4/1974 | Charron | |
| 3,827,239 | A | | 8/1974 | Ulrich, Jr. | |
| 3,894,606 | A | | 7/1975 | Hunck et al. | |
| 3,895,888 | A | * | 7/1975 | Roberts | 418/61.3 |
| 3,906,727 | A | | 9/1975 | Hull | |
| 4,072,131 | A | | 2/1978 | Pentel | |
| 4,131,171 | A | | 12/1978 | Keyes | |
| 4,196,587 | A | | 4/1980 | Shiber | |
| 4,242,066 | A | | 12/1980 | Hodgson | |
| 4,242,922 | A | | 1/1981 | Baudoin | |
| RE31,067 | E | | 10/1982 | Roberts | |
| 4,426,199 | A | | 1/1984 | Wilisthof et al. | |
| 4,484,655 | A | | 11/1984 | Sheppard, Sr. | |
| 4,492,539 | A | | 1/1985 | Specht | |
| 4,493,622 | A | | 1/1985 | Miller | |
| 4,545,748 | A | | 10/1985 | Middlekauf | |
| 4,563,136 | A | | 1/1986 | Gervais et al. | |
| 4,740,142 | A | | 4/1988 | Rohs et al. | |
| 4,812,111 | A | | 3/1989 | Thomas | |
| 4,824,347 | A | | 4/1989 | Diugokecki | |
| 4,897,025 | A | * | 1/1990 | Negishi | 418/171 |
| 4,940,394 | A | | 7/1990 | Gibbons | |
| 5,056,315 | A | | 10/1991 | Jenkins | |
| 5,184,947 | A | | 2/1993 | Coombe | |
| 5,305,721 | A | | 4/1994 | Burtis | |
| 5,306,127 | A | | 4/1994 | Kinney | |
| 5,335,750 | A | | 8/1994 | Geringer et al. | |
| 5,476,374 | A | | 12/1995 | Langreck | |
| 5,540,299 | A | | 7/1996 | Tohda et al. | |
| 5,620,315 | A | | 4/1997 | Pfuhler | |
| 5,724,812 | A | | 3/1998 | Baker | |
| 5,784,883 | A | | 7/1998 | Ohkura et al. | |
| 5,907,952 | A | | 6/1999 | Akasaka et al. | |
| 6,006,519 | A | | 12/1999 | Hormell, Jr. | |
| 6,244,839 | B1 | | 6/2001 | Cole et al. | |
| 6,283,735 | B1 | | 9/2001 | Schreiber et al. | |
| 6,553,759 | B2 | | 4/2003 | Matsufuji | |
| 6,758,656 | B2 | | 7/2004 | Maier et al. | |
| 6,862,885 | B1 | | 3/2005 | Mitchell | |
| 6,877,577 | B1 | | 4/2005 | Smith | |
| 6,971,232 | B2 | | 12/2005 | Singh | |
| 2001/0024618 | A1 | | 9/2001 | Winmill | |
| 2003/0116368 | A1 | | 6/2003 | Winkelman et al. | |
| 2005/0044873 | A1 | | 3/2005 | Tamai et al. | |
| 2005/0178115 | A1 | | 8/2005 | Hughey | |
| 2005/0223706 | A1 | | 10/2005 | Mitchell et al. | |
| 2005/0247504 | A1 | | 11/2005 | Gleasman et al. | |

FOREIGN PATENT DOCUMENTS

| | | | | | |
|---|---|---|---|---|---|
| JP | 57-076284 | A | | 5/1982 | |
| JP | 59015688 | A | * | 1/1984 | 418/21 |
| SU | 400741 | A | | 2/1974 | |

* cited by examiner

LONG LIFE TELESCOPING GEAR PUMPS AND MOTORS

CROSS-REFERENCE TO RELATED APPLICATION

This application is a continuation-in-part of U.S. application Ser. No. 11/844,416 filed on Aug. 24, 2007 that is a continuation of U.S. application Ser. No. 11/359,728 filed on Feb. 22, 2006 that is a continuation-in-part of U.S. application Ser. No. 11/101,837 filed on Apr. 8, 2005, now U.S. Pat. No. 7,179,070.

This application claims the benefit of U.S. provisional application Ser. No. 60/560,897 filed on Apr. 9, 2004, U.S. provisional application Ser. No. 60/655,221 filed on Feb. 22, 2005, and U.S. provisional application Ser. No. 60/824,981 filed on Sep. 8, 2006.

FIELD OF THE INVENTION

The present invention relates generally to vehicle powertrain systems and, in particular, to a telescoping gear pump and motor with novel seals.

BACKGROUND OF THE INVENTION

Telescoping Gear pumps and motors providing variable displacement capabilities prove to be some of the most durable. The sealing however on these functionally durable pumps with variable displacement has been an issue. The seals on the sides of the gears have been maintained by tightly controlling tolerance of the structure that supports the gears. This technique does not accommodate wear of the gears and seals that occurs in the break-in period of the pump/motor. This patent describes a method of eliminating this short coming in an otherwise robust technology.

SUMMARY OF THE INVENTION

In order to accommodate wear, the surfaces in contact with each other must have some wear travel integrated into at least one of the parts in contact.

The attached embodiment shows one method of providing this travel to an internal gear pump/motor. This proposed technology is however being verified with external gear pump/motors and orbital gear pump/motors sometimes referred to as GEROTORS®.

However, it is important that the travel not allow the gears and seals under pressure to separate and leak. This is remedied by inserting a spring or spring like device that applies adequate pressure to ensure seals do not separate under operating pressures. The pressure required to maintain these seals however can be extremely high so high that the seal may gauld and fail completely if the interfacing components of the pump/motor are to operate at some of today's very high pressures needed to keep system weight low. For this reason the face of the gears in the pump/motor most have some material removed to reduce the surface area that pushes against the spring keeping the force applied to the seal surface low enough to avoid damaging or causing accelerated wear to the seal surface.

BRIEF DESCRIPTION OF THE DRAWINGS

The above, as well as other advantages of the present invention will become readily apparent to those skilled in the art from the following detailed description of a preferred embodiment when considered in the light of the accompanying drawings in which:

FIG. 1*e* is a view of the hydraulic hybrid powertrain system of FIG. 1*a* with a brake override device in an override position;

DETAILED DESCRIPTION OF EXEMPLARY EMBODIMENTS OF THE INVENTION

The following patent applications are incorporated herein by reference: U.S. provisional application Ser. No. 60/560,897; U.S. patent application Ser. No. 11/101,837, now U.S. Pat. No. 7,179,070; U.S. provisional application Ser. No. 60/655,221; U.S. patent application Ser. No. 11/359,728; U.S. provisional application Ser. No. 60/824,981; and U.S. patent application Ser. No. 11/844,416.

The telescoping gear pump/motor 300 is described in use with a pump/motor 16 and the motors 76*a*-76*d* are preferably variable displacement pump/motors such as that shown in commonly assigned and co-pending patent application Ser. No. 11/101,837 filed on Apr. 8, 2005, now U.S. Pat. No. 7,179,070, the disclosure of which is hereby incorporated by reference and shown in FIGS. 4 and 5. Alternatively, the pump/motor 16 and the motors 76*a*-76*d* are vane-type or piston-type variable displacement pump/motors or are fixed displacement pump/motors. Additionally, the pump/motor 16 with a telescoping gear 300 may be used in conjunction with a hydraulic hybrid powertrain system 10 such as that shown in commonly assigned and co-pending application Ser. No. 11/359,728 filed on Feb. 22, 2005, the disclosure of which is hereby incorporated by reference and shown in FIGS. 1-3.

Figure 6:
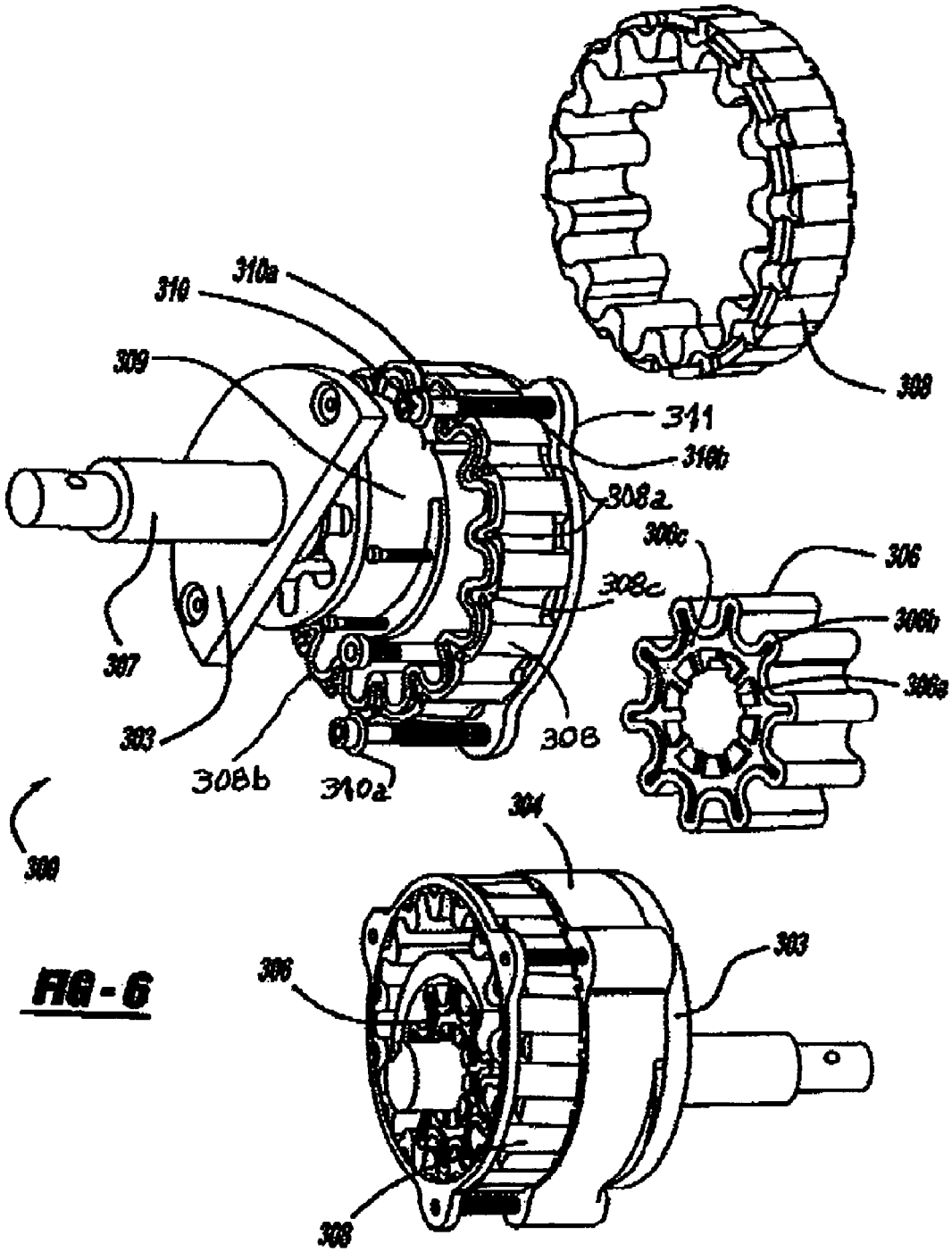
FIG. 6 is a perspective view of the key features of the long life telescoping gear pumps and motors of the present invention.
Figure 7:
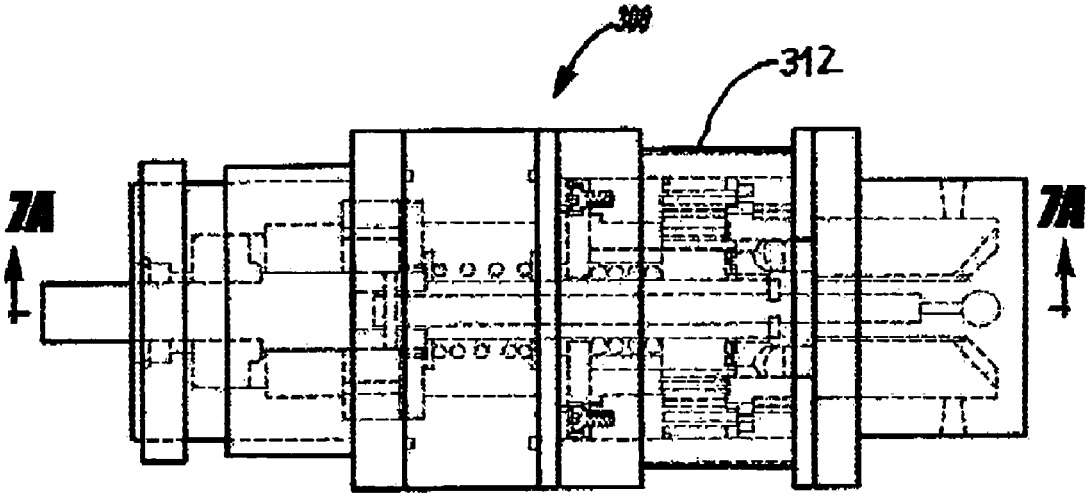
FIG. 7 is a side view of a pump/motor of the present invention.
Figure 8:
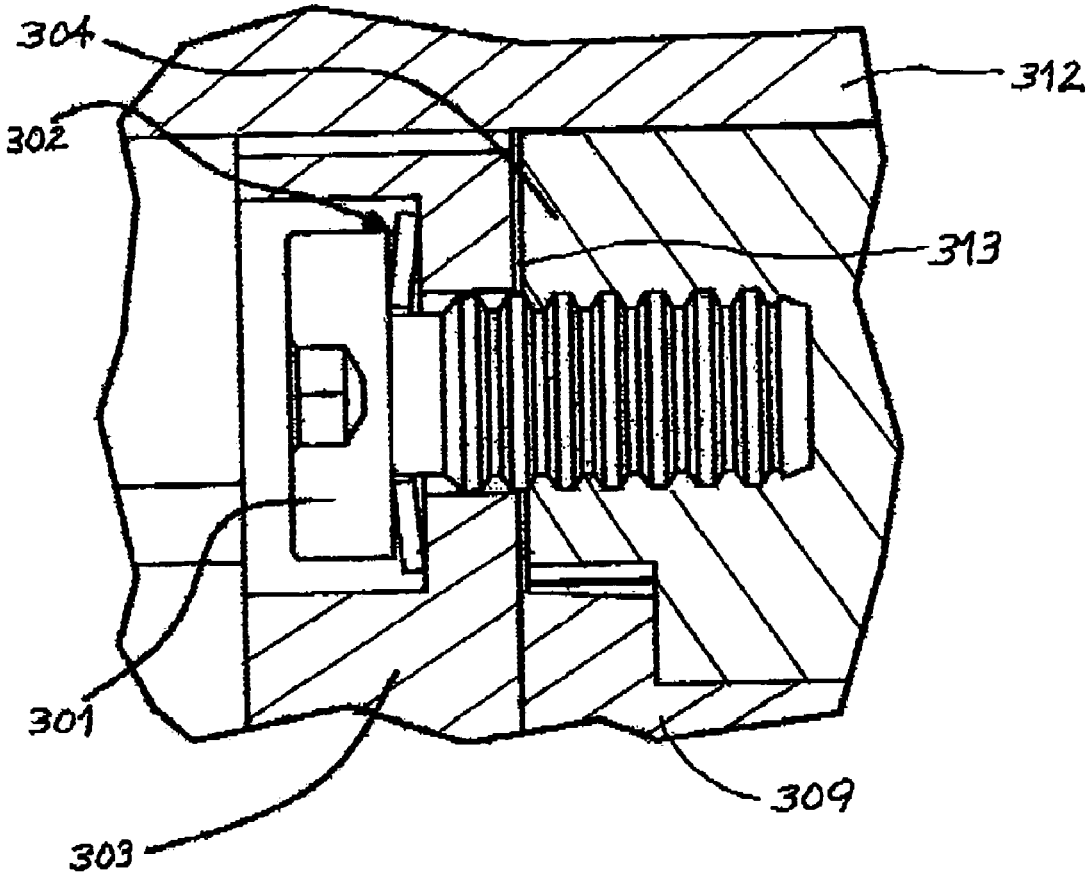
FIG. 8 is a detail of a wear compensator assembly of the present invention.

Referring now to FIGS. 6-8, a telescoping gear pump 300 of the present invention comprises a bolt 301, a Bellville washer 302, a wear plate 303, a seal housing 304, a seal spring 305, a spur gear 306 including a wear lobe 306*a*, a seal ring 306*b* and a case drain path 306*c*, a spur gear shaft 307, a ring gear 308 including a wear lobe 308*a*, a seal ring 308*b*, and a case drain path 308*c*, a spur gear seal 309, a bolt assembly 310 including a Belllville washer 310*a* and a bolt 310*b*, a pressure plate 311, and an outer housing 312. FIG. 6 shows from top to bottom the following views: 1) the ring gear 308 from the end that abuts the pressure plate 311; 2) a sub-assembly of the wear plate 303, the spur gear shaft 307, the ring gear 308 reversed from the view above, the spur gear seal 309 and the wear plate 311; 3) the spur gear 306; and 4) an assembly of all of the parts listed above.

In order to maintain a seal, as parts wear into each other, there must be some travel built into the mating parts. Once this travel is incorporated into the mating parts however, a spring device needs to be added to bias the tolerances of the parts in a direction that maintains the seals under pressure. This seal is maintained for the spur gear 306 by the pressure that is applied to it by the seal spring 305 with one end supported and the other applying force to the spur gear 306. If this were an external gear pump embodiment two spur gear assembly would suffice to provide a long wear pump/motor. Internal gear pumps however have many more packaging constraints. In this location, this embodiment shows Bellville® washer 302 and Bellville® washer 310*a* used in lieu of conventional springs. The function however is identical. In circumstances where the pressure fluctuation is extreme the springs can be replaced with pressure compensated gas springs.

The springs provide the energy needed to provide proper wear characteristics.

However, if the pump/motor is to operate at higher pressures, the force required to maintain the seal between the mating parts could easily gall the sealing surfaces. For this reason a texture added to the sealing surface of the spur gear 306 and the ring gear 308 minimizes the apposing opposing force created by the hydraulic oil or gas by creating seal ring 306*b* and seal ring 308*b*. For example, as shown in FIG. 6, the seal rings 306*b*, 308*b* may each form a narrow band extending along the perimeter of the spur gear 306 and the ring gear 308, respectively. This narrow band creates a continues sealing surface in needed areas of the pump/motor but limits the cross sectional areas that press on the face of spur gear 306 and ring gear 308, reducing the size of the seal spring 302, 305 or 310*a*. This, however, does nothing to the psi of force between the sealing surfaces. For this reason a feature like wear lobe 306*a* and 308*a* are is added to the 306 spur gear and 308 ring gear to increase the surface area to bear the load without increasing the face pressure from 306 spur gear and 308 ring gear. The excess oil or gas that escapes under the face of 306 spur gear or 308 ring gear is guided away in the 306*c* case drain path and 308*c* case drain path.

Figure 7A:
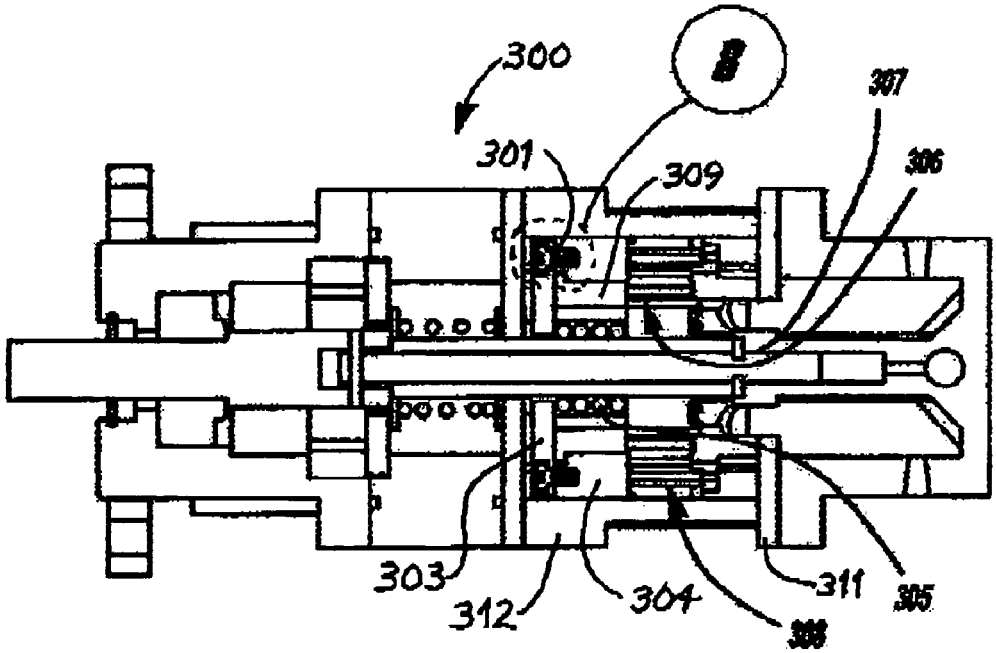
FIG. 7*a* is a cross-section of the pump/motor of the present invention taken along line A-A of FIG. 7.

With particular reference to FIGS. 7, 7A, and 8, the assembled telescoping gear pump/motor 300 according to the present disclosure is shown. The telescoping pump/motor 300 includes a wear compensator assembly, for example, as shown in FIG. 6 and FIG. 8. The wear compensator assembly shown in FIG. 6 includes the seal housing 304 and the spring assembly 310, including the Bellville washer 310*a* with the bolt 310*b*, for example. The wear compensator assembly shown in FIG. 8 includes the wear plate 303 and a spring assembly, including the seal spring 305 and/or the Bellville washer 302 with the bolt 301, for example. As shown in FIG. 8, there is a gap 313 between the facing surfaces of the wear plate 303 and the seal housing 304. As the abutting surfaces of the wear plate 303 and the rotating spur gear seal 309 wear, the spring 302 functions to reduce the gap 313 and maintain the abutting surfaces in contact. A gear such as at least one of the spur gear 306 and the ring gear 308, for example, has teeth and the wear lobe 306*a*, 308*b* (shown in FIG. 6). At least one of the wear lobes 306*a*, 308*b* contacts the wear compensator assembly. It should be understood that the spring assembly applies pressure to oppose the fluid within the telescoping pump/motor to maintain the seal within the telescoping pump/motor 300 during operation thereof. It should be further understood that the wear lobe 306*a*, 308*b* militates against wear while maintaining the fluid pressure.

Figure 1A:
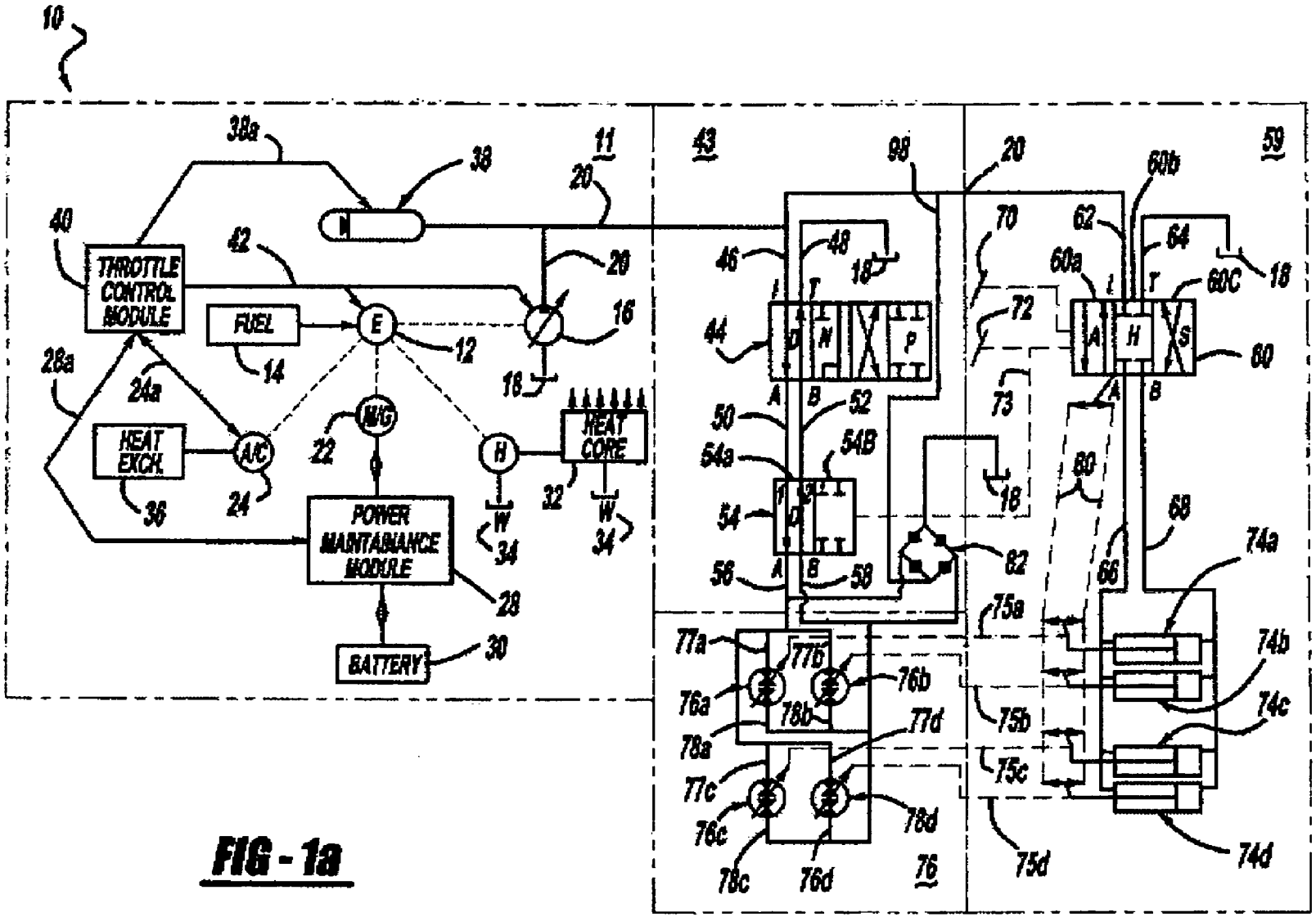
FIG. 1*a* is a schematic view of a hydraulic hybrid powertrain system in accordance with the present invention with a mode select valve in a "Drive" position.
Figure 2:
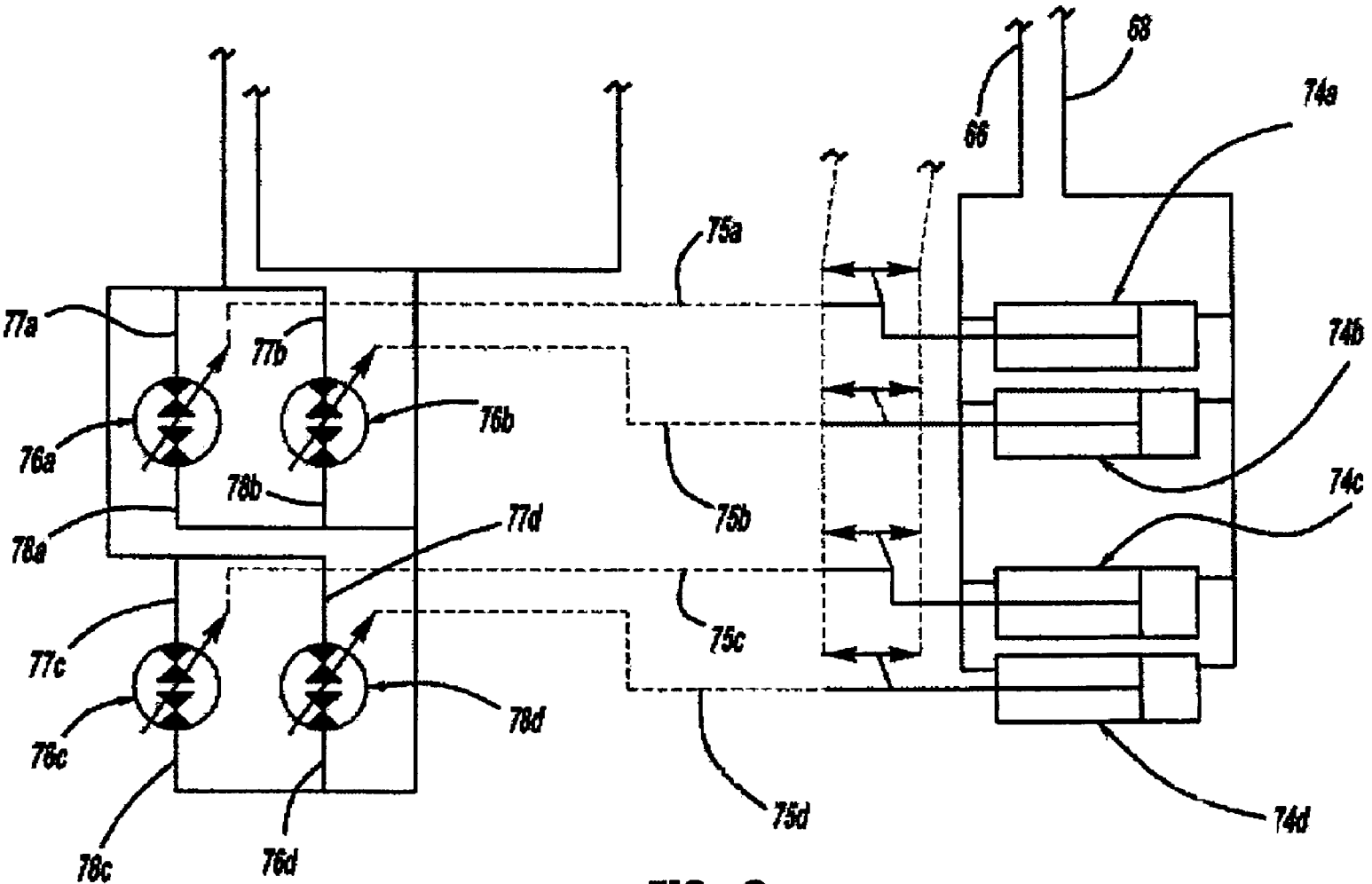
FIG. 2 is a schematic view in an enlarged scale of the drive motors and displacement control devices shown in FIGS. 1*a*-1*d;*

Referring now to FIG. 1*a*, a hydraulic hybrid powertrain system is indicated generally at 10. The powertrain system 10 may be utilized in a variety of installations, such as, but not limited to, an automotive vehicle, a boat, a submarine, a helicopter, or the like as will be appreciated by those skilled in the art, but for clarity will be referred to as if installed in an automotive vehicle in the following description of the present invention. The powertrain system 10 includes a power plant section 11, a mode selector module 43, a control section 59, and a power delivery section 76.

The power plant section 11 of the powertrain system 10 includes an engine 12 in communication with a fuel source 14. The engine 12 may be a conventional internal combustion engine, a turbine engine, an electric motor powered by a battery, a fuel cell, or the like. The engine 12 selectively provides torque to a preferably variable displacement hydraulic pump/motor 16, which is supplied with a low pressure source 18 of hydraulic fluid on an inlet side thereof and a high pressure conduit 20 on an outlet side thereof. The hydraulic fluid may be a liquid, such as but not limited to water, hydraulic fluid, transmission fluid or the like, or any compressible gas while remaining within the scope of the present invention. The pump/motor 16 is described as such because, depending on the mode of the system 10, the device functions alternately as a pump or a motor, discussed in more detail below.

The power plant section 11 of the system 10 includes a plurality of accessory drives including, but not limited to, a motor generator 22, an air conditioning compressor 24, and a heat pump 26. The motor generator 22 is connected to a power maintenance module 28, which is in turn connected to a battery pack 30. The heat pump 26 is in communication with a heater core 32 and both the heat pump 26 and the heater core 32 are in fluid communication with a cooling water source 34 for the engine 12. The air conditioning compressor 24 is in communication with a heat exchanger 36. The accessory drives 22, 24, and 26 are preferably run by respective electric or hydraulic motors. Alternatively, the accessory drives 22, 24, and 26 are selectively mechanically clutched to the engine 12. An accumulator 38 is in fluid communication with the high pressure conduit 20 on the outlet of the pump/motor 16. The accumulator 38 serves as a reservoir for high pressure hydraulic fluid and maintains high pressure in the system 10, such as by being charged with a high pressure gas or the like (not shown), as will be appreciated by those skilled in the art.

A throttle control module 40 receives an input signal from the air conditioning compressor 24 via a signal on a line 24*a*, the power maintenance module 28 via a signal on a line 28*a*, and the accumulator 38 via a signal on a line 38*a*. Based on the input signals on the lines 24*a*, 28*a*, and 38*a*, the throttle control module 40 provides an output signal on a line 42 to control either or both of the engine 12 and the pump/motor 16, discussed in more detail below. The signals on the lines 24*a*, 28*a*, 38*a*, and 42 may be electronic signals or mechanical feedback between the various components and the throttle control module 40. The throttle control module 40 can be any suitable mechanical or electrical device operable to control the operation of the engine 12 and the pump/motor 16 based on one or more inputs.

The mode selector module 43 includes a mode select valve 44 that is in fluid communication with the high pressure conduit 20 by a high pressure inlet conduit 46. The mode select valve 44 is preferably connected to a transmission-like shift lever (not shown) or the like for selectively moving the valve 44 into a one of a "D" or drive position (best seen in FIG. 1*a*), a "N" or neutral position (best seen in FIG. 1*b*), a "R" or reverse position (best seen in FIG. 1*c*), and a "P" or park position (best seen in FIG. 1*d*). The mode select valve 44 includes a low pressure inlet conduit 48 connected thereto adjacent the high pressure inlet conduit 46. The mode select valve 44 also includes a high pressure outlet conduit 50 and a low pressure outlet conduit 52 connected thereto and on an opposing side of the mode select valve 44. Each position P, R, N, D of the mode select valve 44 selectively aligns the internal portion of the position with the conduits 46, 48, 50, and 52 and controls the direction of hydraulic fluid flow in the system 10, discussed in more detail below. While described as "inlet" and "outlet" above during operation each of the conduits 46, 48, 50, and 52 may function as an inlet or an outlet depending on the operating condition of the system 10, discussed in more detail below.

The conduits 50 and 52, in turn, are connected to a brake override device 54. The brake override device 54 also includes a high pressure outlet conduit 56 and a low pressure outlet conduit 58 connected thereto on an opposing side of the brake override device 54. The brake override device 54 has a first or normal position 54*a* and a second or override position 54*b*, discussed in more detail below.

The control section 59 includes a displacement control valve 60 that is in fluid communication with the high pressure conduit 20 by a high pressure inlet conduit 62. The displacement control valve 60 includes a low pressure inlet conduit 64 connected thereto adjacent the high pressure inlet conduit 62. The displacement control valve 60 also includes a high pressure outlet conduit 66 and a low pressure outlet conduit 68 connected thereto on an opposing side of the displacement control valve 60. The displacement control valve 60 is a floating positional valve and includes an accelerator 70 and a brake 72 connected thereto for directing flow from the displacement control valve 60 to a plurality of cylinders 74*a*, 74*b*, 74*c*, and 74*d*. The accelerator 70 and brake 72 are preferably mechanically connected to a respective accelerator pedal and a brake pedal (not shown). The brake 72 is connected to the brake override device 54 via a connector 73. The displacement control valve 60 has a first or acceleration position 60*a*, a second or hold position 60*b*, and a third or deceleration position 60*c*. Each position 60*a*, 60*b*, and 60*c* of the displacement control valve 60 selectively aligns the internal portion of each position 60*a*, 60*b*, and 60*c* with the conduits 62, 64, 66, and 68 and controls the direction of hydraulic fluid flow to the cylinders 74*a*, 74*b*, 74*c*, and 74*d*, best seen in FIG. 2.

Each of the cylinders 74*a*, 74*b*, 74*c*, and 74*d* is mechanically connected via a connector 75*a*, 75*b*, 75*c*, and 75*d*, to a respective and drive or traction motor 76*a*, 76*b*, 76*c*, and 76*d* (in the power delivery section 76), on each of the vehicle wheels. The motors 76*a*-76*d* are preferably variable displacement motors. The position of the connectors 75*a*-75*d* determines the displacement of the motors 76*a*-76*d*, as will be appreciated by those skilled in the art such as by a connection to a swash plate or the like. The high pressure outlet conduit 66 is in fluid communication with one side of a piston (not shown) in each of the cylinders 74*a*-74*d* and the low pressure outlet conduit 68 is in fluid communication with an opposite side of the piston in the cylinders 74*a*-74*d*. While the system 10 is illustrated with a plurality of traction motors 76*a*, 76*b*, 76*c*, and 76*d*, those skilled in the art will appreciate that as few as one motor may be utilized while remaining within the scope of the present invention. For example, in a single motor installation in an automotive vehicle, the output of the single motor is connected to a differential gear which is in turn mechanically connected to a pair of drive wheels. Each of the traction motors 76*a*, 76*b*, 76*c*, and 76*d* have an upper port 77*a*, 77*b*, 77*c*, and 77*d* and a lower port 78*a*, 78*b*, 78*c*, and 78*d*. The direction of the fluid flow through the upper ports 77*a*-77*d* and the lower ports 78*a*-78*d* determines the direction of the motors 76*a*-76*d*. A feedback connector 80 extends between the displacement control valve 60 and the pistons of the cylinders 74*a*-74*d*.

Figure 3:
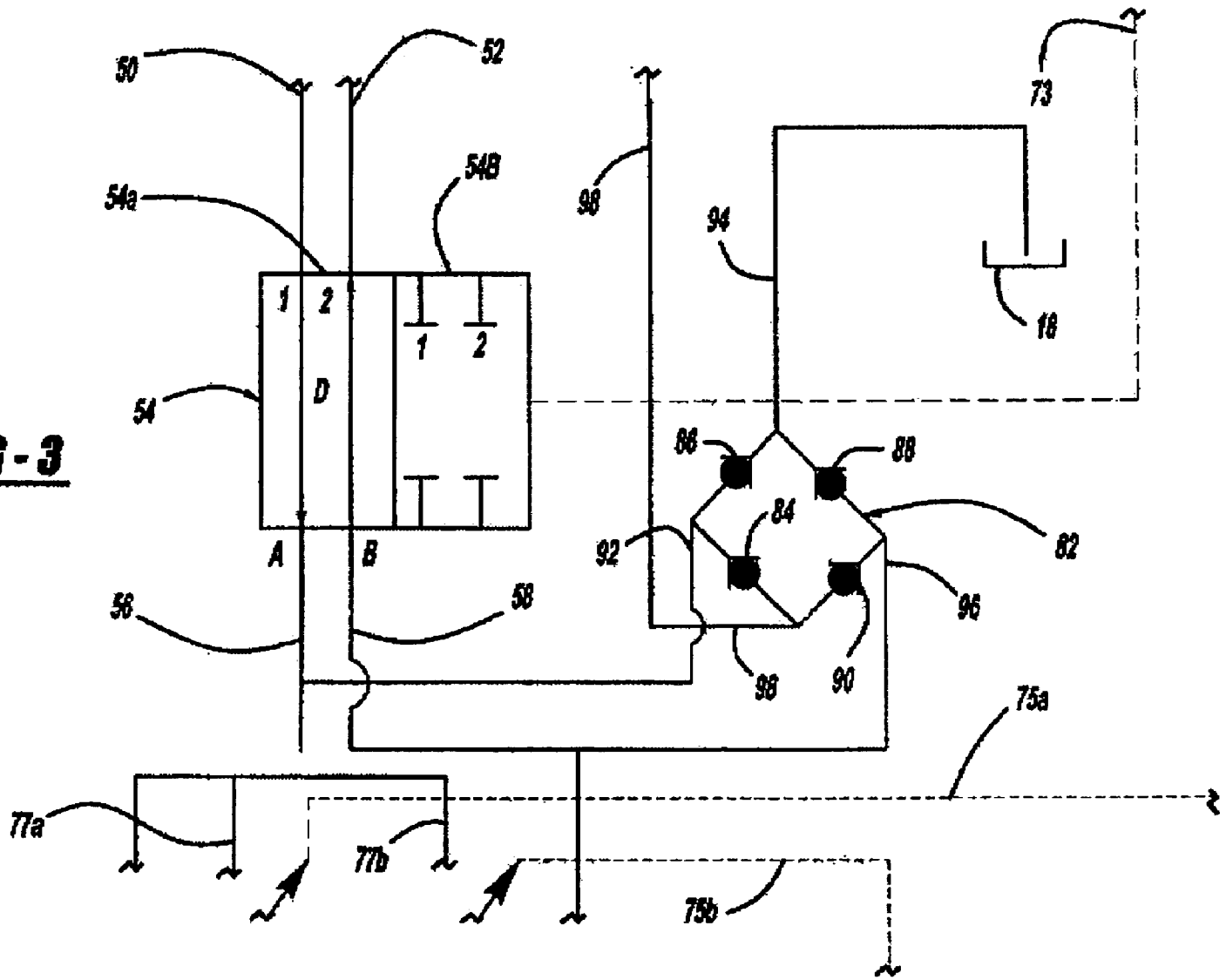
FIG. 3 is a schematic view in an enlarged scale of the brake override device and check valve bridge circuit shown in FIGS. 1*a*-1*d;*

A check valve bridge circuit 82 includes a plurality of check valves 84, 86, 88, and 90 and is arranged in a manner similar to a full-wave bridge rectifier, best seen in FIG. 3. A conduit 92 is in fluid communication with an inlet of the check valve 84 and an outlet of the check valve 86. The conduit 92 is also in fluid communication with the high pressure outlet conduit 56. A conduit 94 is in fluid communication with an inlet of the check valve 86 and an inlet of the check valve 88. The conduit 94 is also in fluid communication with the low pressure source of hydraulic fluid 18. A conduit 96 is in fluid communication with an outlet of the check valve 88 and an inlet of the check valve 90. The conduit 96 is also in fluid communication with the low pressure outlet conduit 56. A conduit 98 is in fluid communication with an outlet of the check valve 84 and an outlet of the check valve 90. The conduit 98 is also in fluid communication with the high pressure conduit 20.

Figure 4:
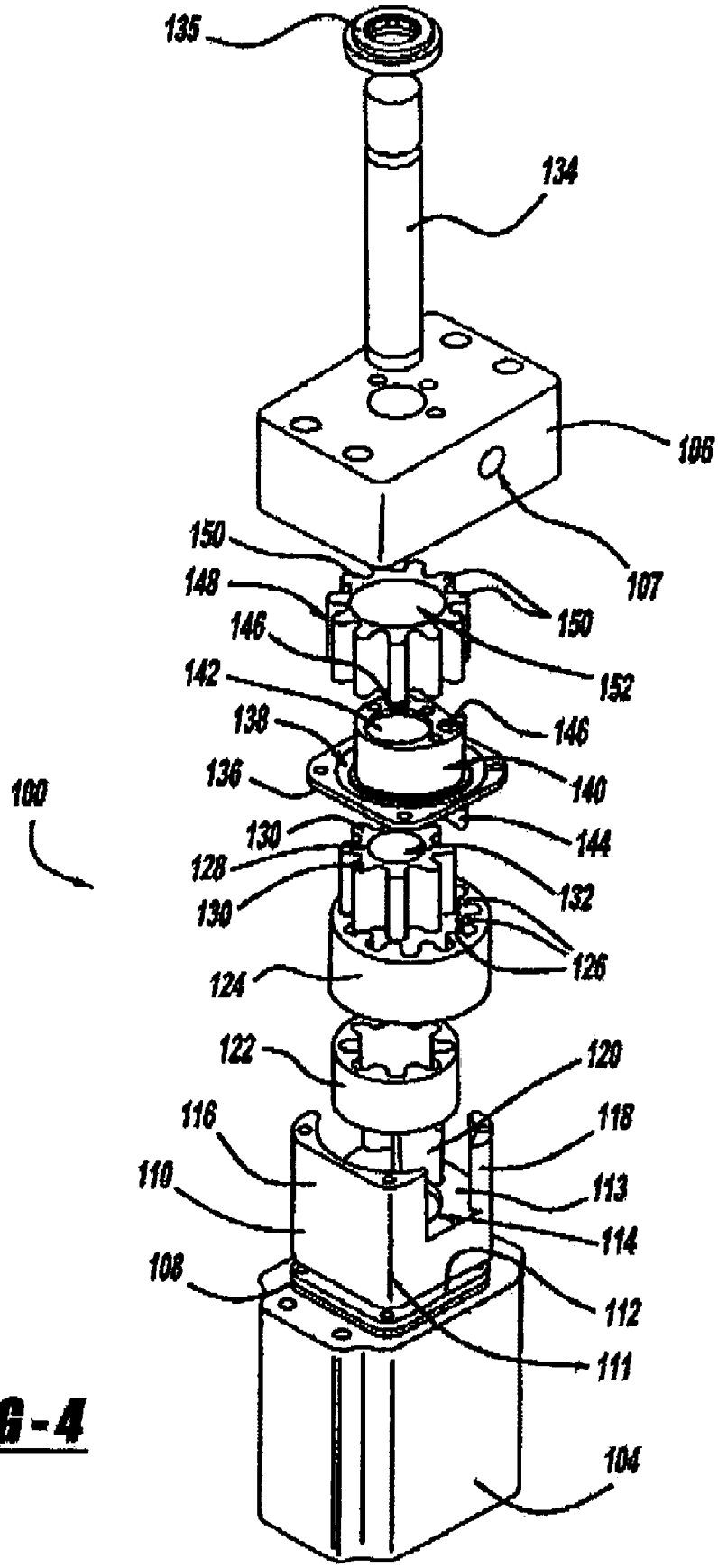
FIG. 4 is an exploded perspective view of an internal gear pump/motor in accordance with the present invention.

Referring now to FIG. 4, an internal gear apparatus in accordance with the present invention is indicated generally at 100. The apparatus 100 may be configured to operate as a motor or as a pump as will be appreciated by those skilled in the art, but will be referred to as a motor in the following description of the present invention. The internal gear motor 100 includes a hollow housing 102 having a base portion 104 and an end cap 106. The base portion 104 defines a recess or cavity 108 therein that is sized to receive a first mandrel 110 and a first piston member 112. The end cap 106 includes at least two ports 107 (only one is shown) that each extend between an internal and an external surface thereof, preferably on opposite sides of the end cap 106. One of the ports 107 is connected to a high pressure segment of a fluid system such as the high pressure conduit 20 of FIGS. 1*a*-1*e*, and another of the ports 107 is connected to a return line or fluid source such as the fluid source 18 of FIGS. 1*a*-1*e*.

The first mandrel 110 defines an aperture 114 extending through a base portion 111 thereof and includes a first outer flange 116 and a plurality of spaced apart second outer flanges 118 extending upwardly from an upper surface 113 of the base portion 111. An inner flange 120 extends upwardly from the base portion 111 of the first mandrel 110 and is located adjacent the aperture 114. The first outer flange 116 is located adjacent the aperture 114. The second outer flanges 118 are spaced apart from both the aperture 114 and the inner flange 120. A first seal bushing 122 is sized to rotatably fit in the aperture 114 and is preferably substantially equal in height to the base portion 111 of the first mandrel 110 such that when the bushing 122 is placed in the aperture 114, an upper surface of the bushing 122 is substantially flush with the upper surface 113 of the base portion 111.

An external gear 124 that is substantially circular in cross section is adapted to be placed atop the upper surface 113 of the base portion 111 wherein a curved outer surface of the gear 124 is adjacent the respective curved inner surfaces of the outer flanges 116 and 118. The external gear 124 includes a plurality of teeth 126 formed on an inner surface thereof.

When placed on the upper surface 113, the gear 124 is fixed axially between the outer flanges 118 and the inner flange 120.

An internal gear 128 that is substantially circular in cross section includes a plurality of teeth 130 formed on an outer surface thereof and defines an aperture 132 extending there through. The teeth 130 are operable to mesh with the teeth 126 formed on the inner surface of the external gear 124. A lower surface of the gear 128 extends into and rotates with the bushing 122, wherein the teeth 130 cooperate with corresponding teeth on the bushing 122 when the motor 100 is assembled and operated, as discussed in more detail below. The respective outer surfaces of the teeth 130 of the internal gear 128 are adjacent the inner surface of the inner flange 120. The aperture 132 is adapted to receive a free end of a drive or output shaft 134 when the motor 100 is assembled. The internal gear 128 is axially moveable along the shaft 134. The drive shaft 134 is rotatably supported in the end cap 106 by a bearing 135, such as a ball bearing, a roller bearing or the like. The free end of the drive shaft 134 extends a predetermined distance beyond the upper surface of the end cap 106 and acts as an output shaft for the motor 100.

A second piston member 136 defines an aperture 138 on an interior portion thereof and is adapted to be mounted on respective upper surfaces of the outer flanges 116 and 118 of the first mandrel 110. The second piston 136 and the first piston 112, therefore, are mounted on the upper surface and the lower surface, respectively of the lower mandrel 110.

A second mandrel 140 is adapted to be disposed in the aperture 138 of the second piston member 136 and defines an aperture 142 on an interior portion thereof for receiving the drive shaft 134. The second mandrel 140 includes a downwardly extending flange 144 that cooperates with the upwardly extending inner flange 120 of the first mandrel 110 when the motor 100 is assembled. The upper mandrel 140 includes a pair of bores 146 extending there through for fluid communication with the gears 122 and 124 during operation of the motor 100.

A second seal bushing 148 includes a plurality of teeth 150 formed on an exterior surface thereof and defines an aperture 152 extending therethrough. The second seal bushing 148 is adapted to receive the upper mandrel 140 in the aperture 152 and be received in the external gear 124 and rotates therewith, wherein the teeth 126 cooperate with the teeth 150 on the bushing 148 when the motor 100 is assembled and operated, as discussed in more detail below.

When the motor 100 is assembled, the first mandrel 110 and the first piston 112 are placed in the base portion 104 of the housing 102, the first seal bushing 122 is placed in the mandrel 110, and the external gear 124 is placed on the mandrel 110. The internal gear 132 and the second mandrel 138 are mounted on the drive shaft 134 and assembled such that the respective teeth 126 and 130 of the gears 132 and 124 rotatably mesh and the internal gear 132 engages with the first seal bushing 122. The second piston 136 is attached to the upper surface of the mandrel 110, and the second seal bushing 148 is placed on the second mandrel 138 and engages with the external gear 124. The downwardly extending flange 144 cooperates with the upwardly extending inner flange 120 to divide the interior of the external gear into an inlet chamber and discharge chamber of the motor 100 and the upper end cap 106 is attached to the base portion 104 to enclose the housing 102. The flanges 120 and 144 extend radially between the teeth 126 and the teeth 130 to form the inlet chamber on one side of the flanges and the discharge chamber on the other side of the flanges.

In operation, the shaft 134 is connected to a load (not shown), such as a wheel of a vehicle or the like. Pressured fluid is introduced from the fluid system such as from the high pressure conduit 20 of FIGS. 1*a*-1*e*, through one of the ports 107, is routed to the inlet chamber side of the gears 124 and 128 through the bores 146, acts against the meshing teeth 126 and 130 to rotate the gears and the shaft, flows between the teeth to the discharge chamber and is discharged through the other the bores 146 to the other of the ports 107. The first seal bushing 122 provides a rotating seal between the internal gear 128 and the first mandrel 110 and the second seal bushing 148 provides a rotating seal between the external gear 124 and the second mandrel 140 to ensure the integrity of the inlet and discharge chambers. The motor 100 in accordance with the present invention requires only the seals 122 and 148 to maintain a fluid seal and allow for efficient operation of the motor 100.

The normal or default spatial relationship between the teeth 126 and 130 of the gears 124 and 128 is such that the teeth 126 and 130 engage substantially all of the axial area of the teeth. In such a relationship, the motor 100 produces its maximum volume flow or maximum output. The motor 100 in accordance with the present invention may advantageously vary from its maximum displacement because the internal gear 128 is axially movable along the shaft 134. When the internal gear 128 moves towards the first mandrel 110, less of the axial area of the teeth 126 and 130 engage, which reduces the volume flow or displacement of the motor 100.

When the unit 100 is configured as a motor, an external source of pressure, such as hydraulic fluid from an external hydraulic pump, compressed air from an air compressor or the like, provides a volume flow to the ports 107 to spin the gears 124 and 128 and produce an output torque on the shaft 134. As the pressure is varied, the internal gear 128 will move along the axis of the shaft 134 in order to vary the output horsepower of the motor 100. The motor 100 may be advantageously utilized to control output rpm under widely changing output loads including, but not limited to automotive vehicles, turrets, large machinery, earth movers, large well drills, ships, farm equipment, or the like.

When the unit 100 is configured as a pump and a prime mover, such as the engine 12 of FIGS. 1*a*-1*e*, rotates the shaft 134 at a lower speed or with a lower torque, the pump 100 will react to the reduced input speed or input torque by varying its output based on the internal pressures in the pump housing 102. In this condition, the output port 107 will create a higher back pressure in the discharge chamber, and the internal gear 128 will move along the axis of the shaft 134 to a point along the axis where the gear 128 is at or near equilibrium to continue operation. The pump 100, therefore, can vary from a maximum output or displacement where the internal gear 128 is substantially adjacent the upper mandrel 140 to a minimum displacement where the internal gear 128 is substantially adjacent the lower mandrel 110.

Figure 5:
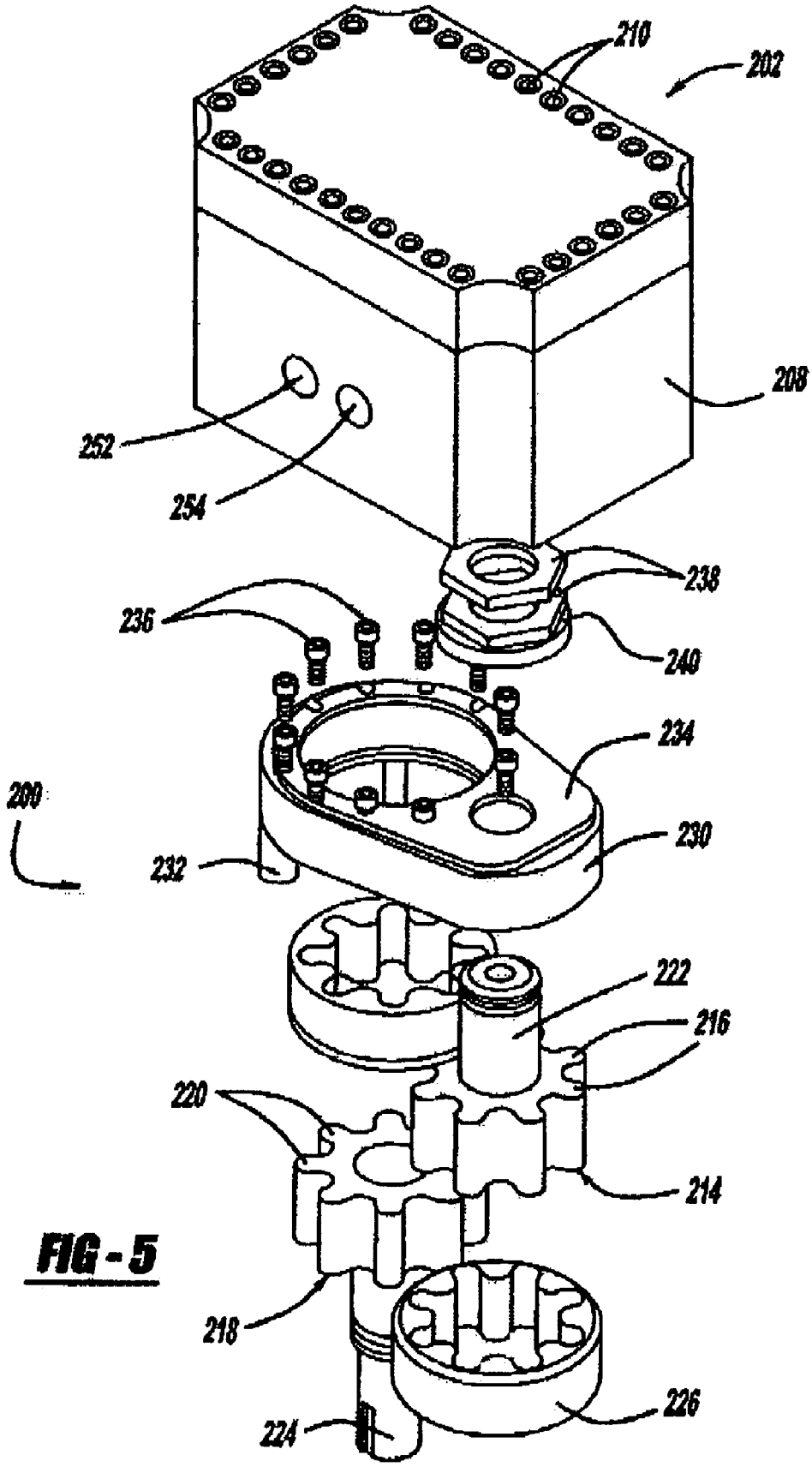
FIGS. 5 and 5A are partial exploded perspective views of an external gear pump/motor in accordance with the present invention.
Figure 5A:
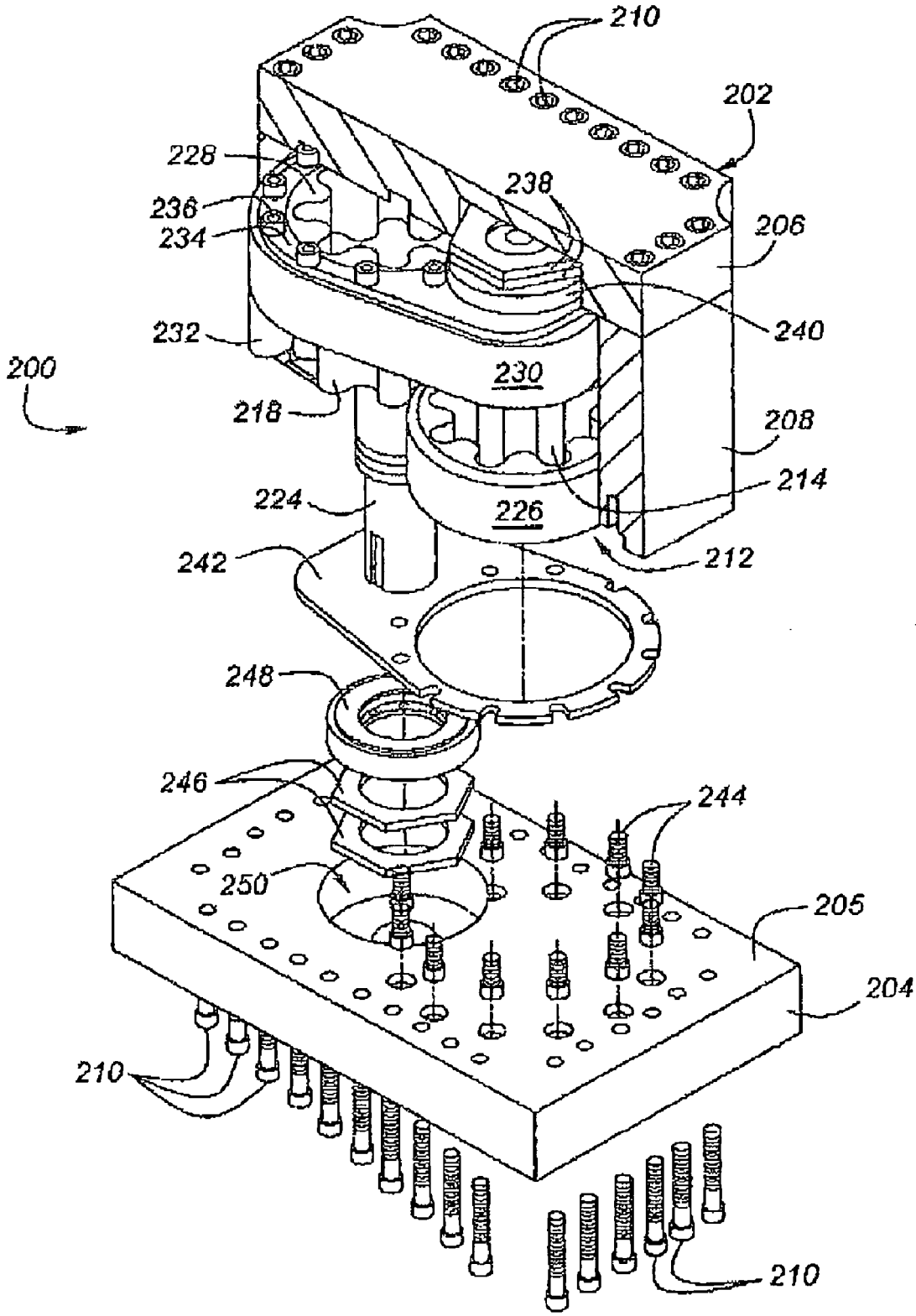

Referring now to FIGS. 5 and 5A, an external gear apparatus in accordance with the present invention is indicated generally at 200. The apparatus 200 may be configured to operate as a pump or a motor as will be appreciated by those skilled in the art, but will be referred to as a pump in order to simplify the description of the present invention. The external gear pump 200 includes a hollow housing 202 having a first end cap 204 and a second end cap 206 connected by a body portion 208. Preferably, the first end cap 204 and the second end cap 206 are attached to the body portion 208 by a plurality of fasteners 210, such as high strength bolts or the like. The body portion 208 defines a recess 212 therein.

A first gear 214 having a plurality of teeth 216 formed on an external surface thereof and a second gear 218 having a plurality of teeth 220 formed on an external surface thereof are adapted to be disposed in the recess 212 of the housing 202. The teeth 216 and 220 of the respective gears 214 and 218 are operable to rotatably mesh in the recess or pump cavity 212 during operation of the pump 200. The first gear 214 has a shaft 222 extending therefrom and the second gear 216 has a stepped shaft 224 extending therefrom. The first gear 214 is fixed on the shaft 222 and the second gear 218 is axially moveable along the shaft 224. The shafts 222 and 224 extend in opposite axial directions and the shaft 224 is greater in length than the shaft 222. A first seal sleeve 226 having internal teeth receives the first gear 214 and a second seal sleeve 228 having internal teeth receives an end of the second gear 218.

A plate fitting 230 includes a flange 232 extending downwardly therefrom and is attached to a first thrust plate 234 on a planar upper surface thereof. Preferably, the thrust plate 234 is attached to the fitting 230 by a plurality of fasteners 236, such as high strength bolts or the like. A free end of the shaft 222 extends through an opening formed in the fitting 230 and the thrust plate 234. The free end of the shaft 222 is rotatably secured in the fitting 230 and the thrust plate 234 by a pair of nuts 238 and is rotatably supported by a bearing 240, such as a ball bearing, a roller bearing or the like. The second seal sleeve 228 is operable to be received in a recess in the fitting 230 adjacent the flange 232. When the shaft 222 is mounted in the fitting 230 and the thrust plate 234, the gear 214 is fixed axially with respect to the housing 202.

A second thrust plate 242 is attached to an upper surface 205 of the first end cap 204 by a plurality of fasteners 244, such as high strength bolts or the like. The plate 242 includes an aperture for receiving a free end of the shaft 224 and a larger aperture for receiving and locating the first seal sleeve 226 adjacent the upper surface of the first end cap 204. The free end of the shaft 224 extends through the aperture in the plate 242, threadably engages a pair of nuts 246 at the step and is rotatably supported by a bearing 248, such as a ball bearing, a roller bearing or the like. The bearing 248 is preferably disposed in a cavity 250 formed in the upper surface 205 of the first end cap 204 while the nuts 246 attach the shaft 224 to the end cap on a lower surface opposite the upper surface 205. The free end of the shaft 224 extends a predetermined distance beyond the lower surface of the end cap 204 and acts as a drive shaft or output shaft for the pump 200.

The body portion 208 defines a first port 252 and a second port 254 that each extend between an internal and an external surface thereof. One of the ports 252 and 254 is connected to a low pressure segment of a fluid system such as the hydraulic fluid source 18 of FIGS. 1*a*-1*e* or the like, and another of the ports 252 and 254 is connected to a high pressure or pressurized segment of a fluid system such as the high pressure conduit 20 of FIGS. 1*a*-1*e*.

In operation, the shaft 224 is connected to a prime mover, such as the engine 12 of FIGS. 1*a*-1*e* or the like. When the prime mover rotates the shaft 224, the gear 218 rotates and causes the gear 214 to rotate. Fluid is introduced from the fluid system through one of the ports 252 or 254, is trapped between the meshing teeth 216 and 220 as is well known in the art and is discharged through the other of the ports 252 or 254. Suitable passages are formed in the housing 202 to ensure that the fluid is routed correctly during operation of the pump 200. The first seal sleeve 226 provides a rotating seal between the first gear 214 and the upper surface 205 and the second seal sleeve 228 provides a rotating seal between the second gear 218 and the fitting 230 to ensure the integrity of the pump cavity 212. The pump 200 in accordance with the present invention requires only the seal sleeves 226 and 228 to maintain a seal and allow for efficient operation of the pump 200.

The normal or default spatial relationship between the teeth 216 and 220 of the gears 214 and 218 is such that the teeth 216 and 220 engage substantially all of the axial area of the teeth. In such a relationship, the pump 200 produces its maximum volume flow or maximum displacement. The pump 200 in accordance with the present invention may advantageously vary from its maximum displacement because the second gear 218 is axially movable along the shaft 224. When the second gear 218 moves towards the lower thrust plate 242, less of the axial area of the teeth 216 and 220 engage, which reduces the volume flow or displacement of the pump 200. Typically, this will occur when the prime mover rotates the shaft 224 at a lower speed or with a lower torque and the pump 200 will react to the reduced input speed or input torque by varying its output based on the internal pressures in the pump housing 202. In this condition, the output port 252 or 254 will create a higher back pressure in the recess 212, and the second gear 218 will move along the axis of the shaft 224 to a point along the axis where the gear 218 is at or near equilibrium to continue operation. The pump 200, therefore, can vary from a maximum output or displacement where the gear 218 is substantially adjacent the fitting 230 to a minimum displacement where the gear 218 is substantially adjacent the lower thrust plate 242.

When the apparatus 200 is configured as a motor, an external source of pressure, such as hydraulic fluid from an external hydraulic pump, compressed air from an air compressor or the like, provides a volume flow to the ports 252 and 254 to spin the gears 214 and 218 and produce an output torque on the shaft 224. As the pressure is varied, the second gear 218 will move along the axis of the shaft 224 in order to vary the output horsepower of the motor 200. The motor 200 may be advantageously utilized to control output rpm under widely changing output loads including, but not limited to automotive vehicles, turrets, large machinery, earth movers, large well drills, ships, farm equipment, or the like.

In operation of the system 10, the engine 12 is started and supplies torque to the pump/motor 16, which in turn supplies pressurized hydraulic fluid to the high pressure conduit 20. The accumulator 38 ensures that the hydraulic pressure within the conduit 20 remains relatively stable and provides energy storage in a manner well known to those skilled in the art. The pressure in the conduit 20 is transmitted to the conduits 46, 62, and 98.

Referring to FIG. 1*a*, when the mode select valve 44 is in the D or drive position and the brake override device 54 is in the 54*a* position, hydraulic fluid will flow through the conduit 46, through the mode select valve 44 and out the conduit 50 in the direction shown by the arrow in the D position, through the brake override device 54 and out the conduit 56 in the direction shown by the arrow in the 54*a* position, and to the respective upper ports 77*a*-77*d* of the motors 76*a*-76*d*, through the motors 76*a*-76*d* and to the respective lower ports 78*a*-78*d*, dropping in pressure and providing an output torque in a forward direction for each of the motors 76*a*-76*d* in a manner known to those skilled in the art. The lower pressure hydraulic fluid in the lower ports 78*a*-78*d* travels through the conduit 58, through the brake override device and out the conduit 52 in the direction shown by the arrow in the 54*a* position, and through the mode select valve 44 and out the conduit 48 in the direction shown by the arrow in the D position to the hydraulic fluid source 18.

Figure 1B:
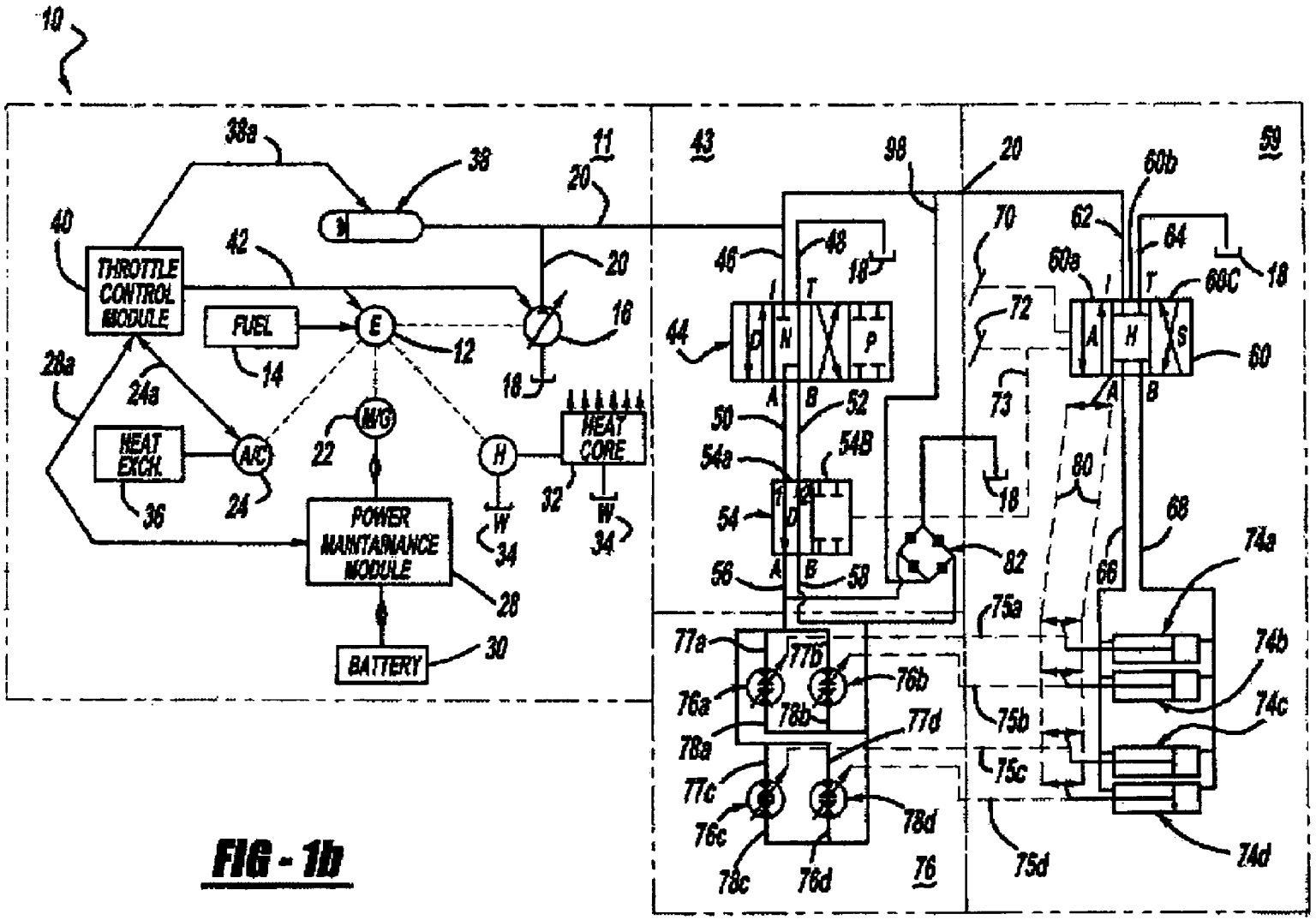
FIG. 1*b* is a view of the hydraulic hybrid powertrain system of FIG. 1*a* with the mode select valve in a "Neutral" position.

Referring to FIG. 1*b*, when the mode select valve 44 is in the N or neutral position, and the brake override device 54 is in the 54*a* position, hydraulic fluid will flow through the conduit 46 but will be prevented from flowing through the mode select valve 44 by the cap adjacent the conduit 46 in the N position. The outlet conduits 50 and 52 are in fluid communication with the lower pressure hydraulic fluid in the conduit 48 and, therefore, there is no fluid flow through the brake override device 54 or to the motors 76*a*-76*d*, as the pressure in the conduits 50 and 56 will balance with the pressure in the conduits 52 and 58. When the in N position, oil from the reservoir 18 is available to flow through to the motors 76*a*-76*d* should any of the motors 76*a*-76*d* require oil flow.

Figure 1C:
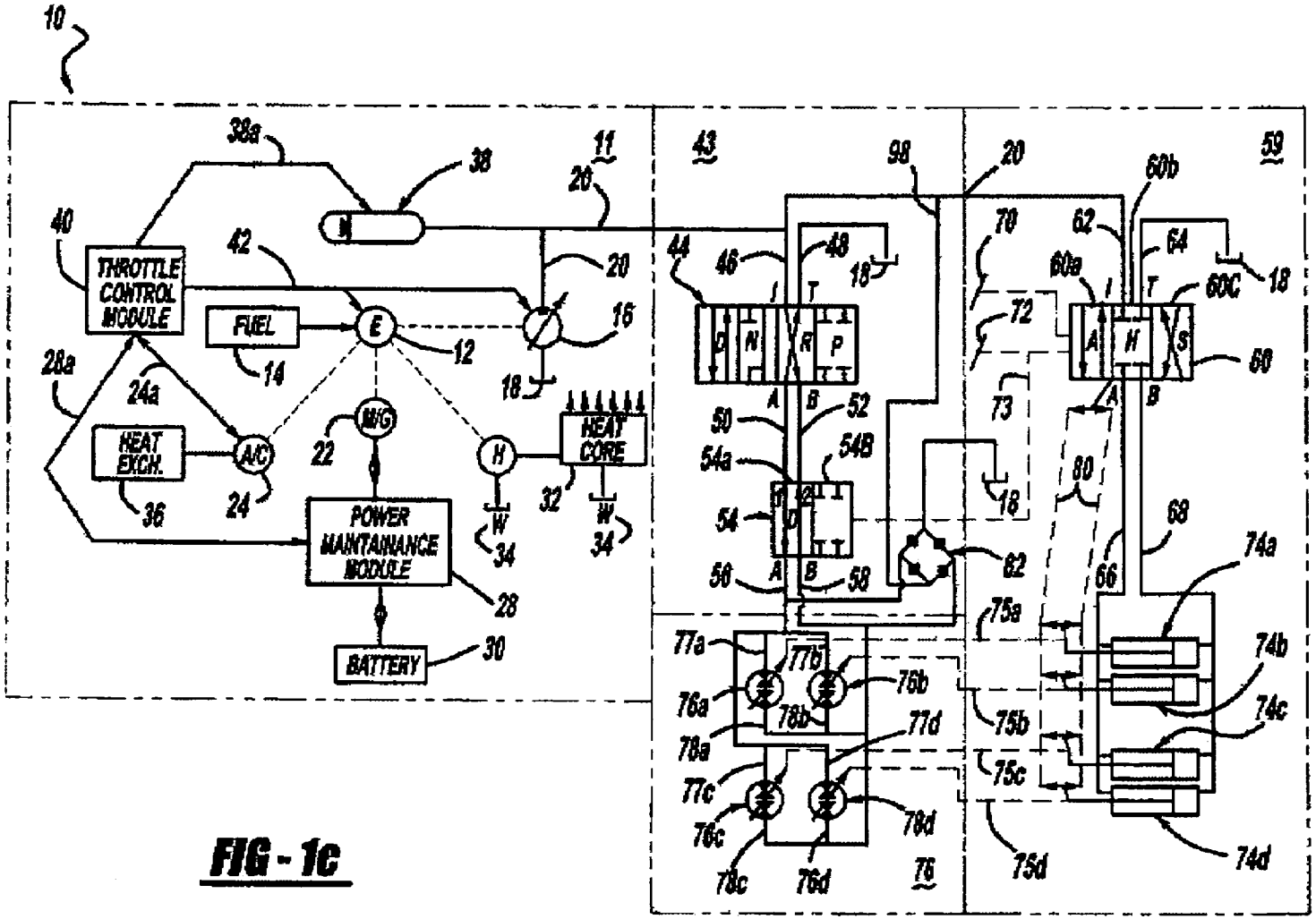
FIG. 1*c* is a view of the hydraulic hybrid powertrain system of FIG. 1*a* with the mode select valve in a "Reverse" position.
Figure 1D:
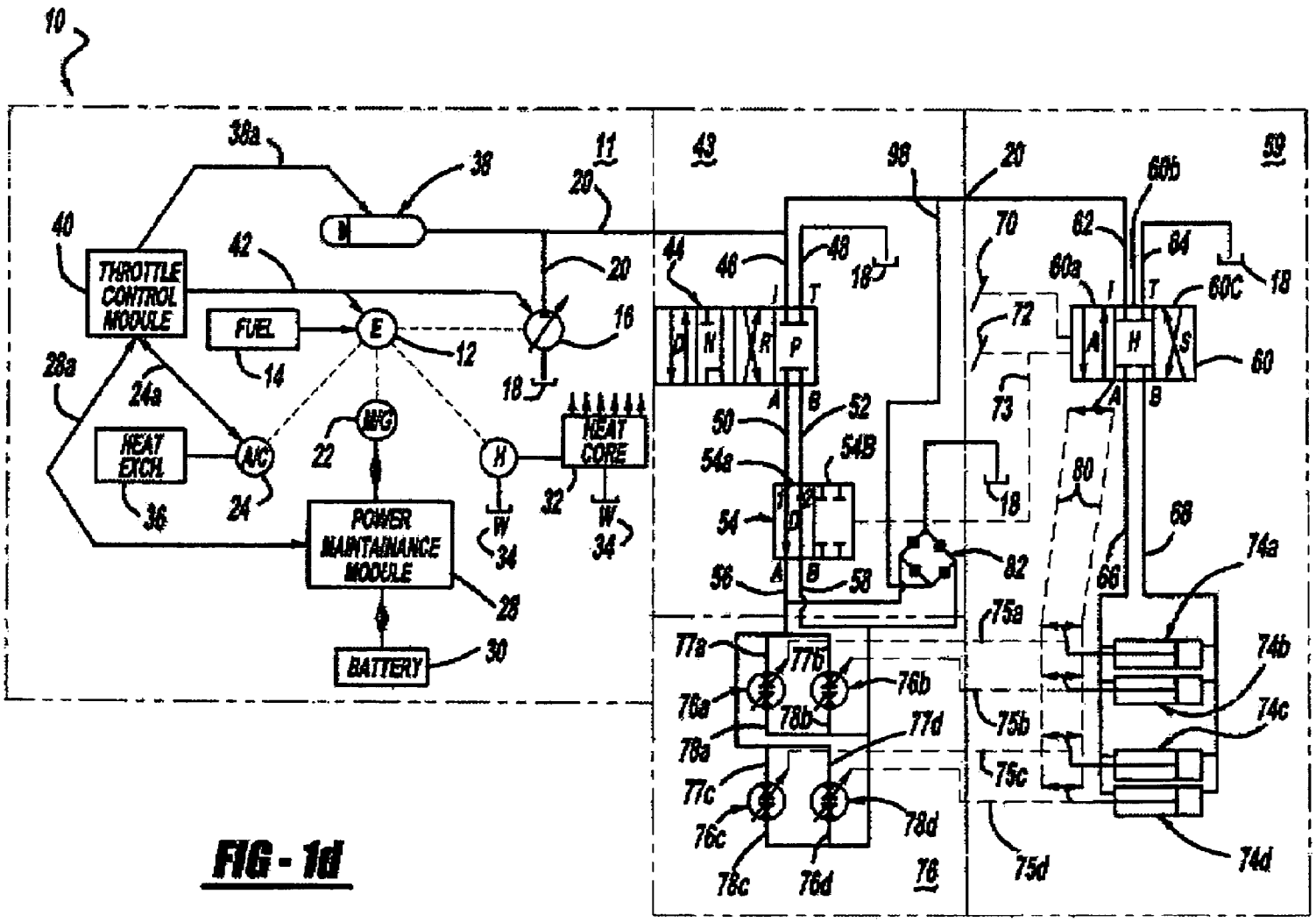
FIG. 1*d* is a view of the hydraulic hybrid powertrain system of FIG. 1*a* with the mode select valve in a "Park" position.
Figure 1B:
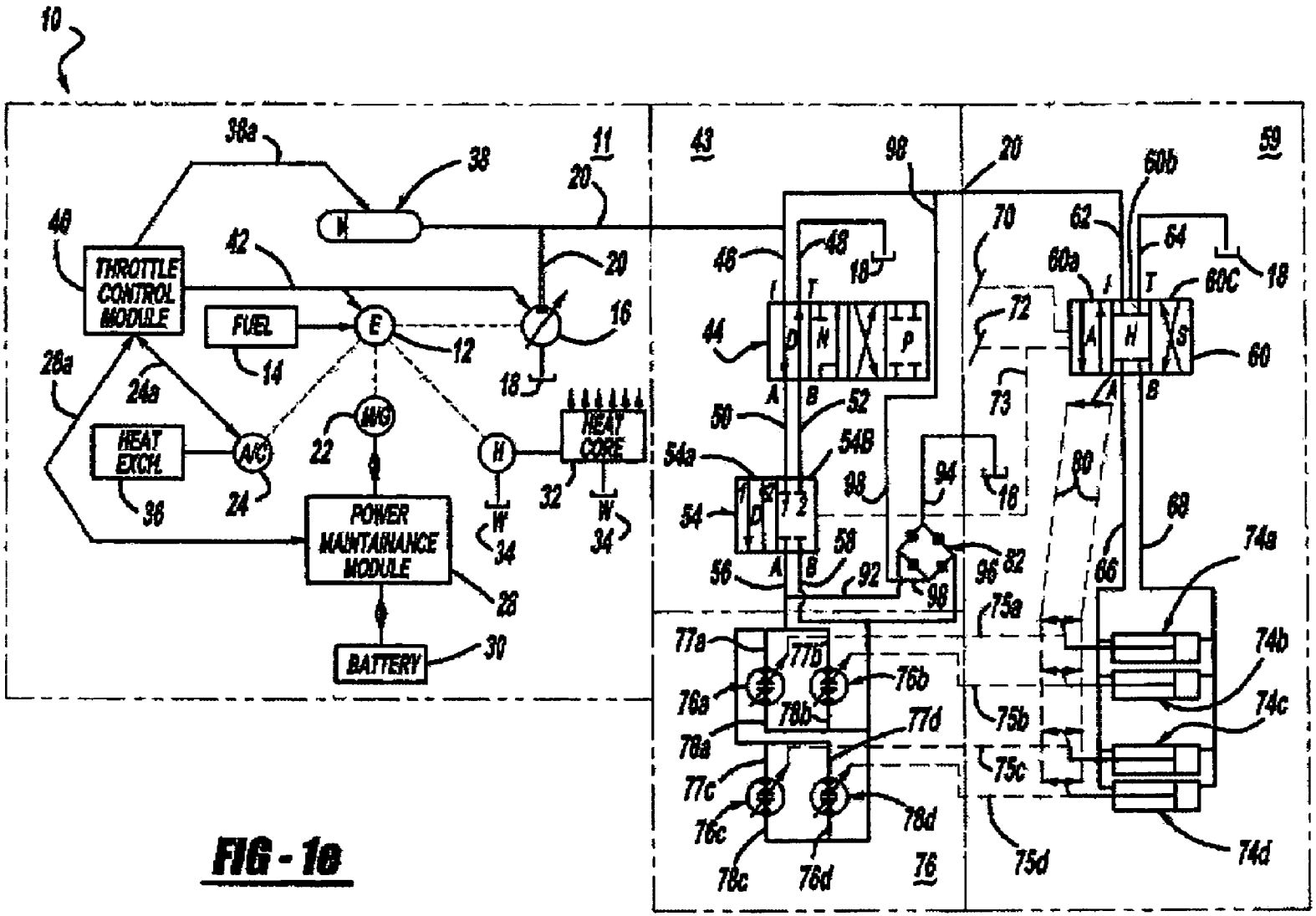

Referring to FIG. 1*c*, when the mode select valve 44 is in the R or reverse position, and the brake override device 54 is in the 54*a* position, hydraulic fluid will flow through the conduit 46, through the mode select valve 44 and out the conduit 52 in the direction shown by the arrow in the R position, through the brake override device 54 and out the conduit 58 in the direction shown by the arrow in the 54*a* position, and to the respective lower ports 78*a*-78*d* of the motors 76*a*-76*d*, through the motors 76*a*-76*d* and to the respective upper ports 77*a*-77*d*, dropping in pressure and providing an output torque in a reverse direction for each of the motors 76*a*-76*d* in a manner known to those skilled in the art. The lower pressure hydraulic fluid in the lower ports 77*a*-77*d* travels through the conduit 56, through the brake override device and out the conduit 50 in the direction shown by the arrow in the 54*a* position, and through the mode select valve 44 and out the conduit 48 in the direction shown by the arrow in the D position to the hydraulic fluid source 18.

Referring to FIG. 1 *d*, when the mode select valve 44 is in the P or park position, and the brake override device 54 is in the 54*a* position, hydraulic fluid will not flow through any of the conduits 46, 48, 50, and 52 as the caps adjacent each of the conduits 46, 48, 50, and 52 in the P position prevent any flow through to the motors 76*a*-76*d*.

As outlined above, in the first position 54*a*, the brake override device 54 allows hydraulic fluid to flow (depending on the position of the mode select valve 44) between the conduits 50 and 56, and between the conduits 52 and 58. In the second position 54*b*, however, best seen in FIG. 1*e*, hydraulic fluid will not flow through any of the conduits 50, 52, 56, and 58 as the caps adjacent each of the conduits 50, 52, 56, and 58 in the second position 54*b* prevent any flow through the brake override device 54. The brake override device 54 is moved from its normal first position 54*a* to the second position 54*b* by actuation of the brake 72 and the transmission of a signal along the connector 73 and prevents hydraulic fluid flow from the displacement control valve 44 to the motors 76*a*-76*d*.

In operation, if the brake 72 is engaged when the mode select valve 44 is in the D or drive position, and the override device 54 is moved to the second position 54*b*, the only source of hydraulic fluid for the motors 76*a*-76*d* is through the check valve bridge circuit 82 and, therefore, all fluid flow is routed through the check valve bridge circuit 82. During braking, the motors 76*a*-76*d* will begin to function as pumps, advantageously recapturing energy from the rotation of the vehicle wheels during braking. When braking in the D position, hydraulic fluid will flow from the hydraulic fluid source 18, through the conduit 94, through the check valve 86, through the conduit 92, to the upper ports 77-77*d* and to the motors 76*a*-76*d*, where the hydraulic fluid pressure is raised. High pressure hydraulic fluid will then flow from the motors 76*a*-76*d*, through the lower ports 78*a*-78*d*, through the conduit 96, and, if the pressure in the conduit 96 is greater than the conduit 98, through the check valve 90 and into the conduit 98, where the high pressure hydraulic fluid flows to the conduit 20 and recharges the accumulator 38.

When braking while the mode select valve 44 is in the R position, hydraulic fluid will flow from the hydraulic fluid source 18, through the conduit 94, through the check valve 88, through the conduit 96, to the lower ports 78*a*-78*d* and to the motors 76*a*-76*d*, where the hydraulic fluid pressure is raised. High pressure hydraulic fluid will then flow from the motors 76*a*-76*d*, through the upper ports 77*a*-77*d*, through the conduit 92, and, if the pressure in the conduit 92 is greater than the conduit 98, through the check valve 84 and into the conduit 98, where the high pressure hydraulic fluid flows to the conduit 20 and recharges the accumulator 38.

The check valve bridge circuit 82 functions to prevent flow of hydraulic fluid to the motors 76*a*-76*d* in a reverse direction once the vehicle has come to a complete stop. When braking and when the mode select valve 44 is in the D position, the brake override device 54 moves to the position 54*b* and prevents flow from the mode select valve 44 to the motors 76*a*-76*d*. Flow from the high pressure conduit 20 will attempt to reach the motors 76*a*-76*d* via the conduit 98 but is prevented from flowing to the motors via the check valves 84 and 90. The check valve bridge circuit 82 will allow flow to the conduit 98 only from the conduit 92 through the check valve 84 or from the conduit 96 via the check valve 90, which will only occur when the pressure in the conduits 56 and 92 or the conduits 58 and 96 are greater than the pressure in the conduit 98. If the pressure in the conduit 92 is less than the pressure in the conduit 98 and the conduit 94, the check valve 86 will open but since the conduit 94 is at a low pressure, no flow can occur from the reservoir 18 to the conduit 92. Similarly if the pressure in the conduit 96 is less than the pressure in the conduit 98 and the conduit 94, the check valve 88 will open but since the conduit 94 is at a low pressure, no flow can occur from the reservoir 18 to the conduit 96, and advantageously preventing high pressure hydraulic fluid from causing the motors 76*a*-76*d* to engage in a reverse direction after the vehicle has come to a complete stop.

In operation, the flow of the hydraulic fluid through the system 10 is controlled by the operator via the accelerator 70 and the brake 72 connected to the displacement control valve 60. The connector 80 and the connections 75*a*-75*d* are connected together via suitable linkage or the like, which allows the motors 76*a*-76*d* to provide feedback to the displacement control valve 60 via the connections 75*a*-75*d* in a similar manner as the connector 80 provides control to the motors 76*a*-76*d* through the connections 75*a*-75*d*.

For example, if a user (not shown) of the vehicle presses the accelerator 70, this causes the feedback connector 80 to move in an acceleration direction and causes the displacement control valve 60 to move toward the position 60*a*. High pressure fluid from the conduit 62 will flow through the ports on the displacement control valve 60, increasing the pressure in the conduit 66 and flowing to the cylinders 74*a*-74*d*. Since the pressure in the conduit 66 will be greater than the pressure in the conduit 68, the connectors 75*a*-75*d* will be moved in an acceleration direction, increasing the displacement and, therefore, the output torque of the motors 76*a*-76*d*.

Once a desired output torque of the motors 76*a*-76*d* has been reached, the motors 76*a*-76*d* will throttle back, moving the connectors 75*a*-75*d* in a deceleration direction, decreasing the pressure in the conduit 66 and increasing the pressure in the conduit 68. This movement is translated back to the displacement control valve 60 by the feedback connector 80, which moves the displacement control valve towards the position 60*b*. In the position 60*b*, there is no flow through the displacement control valve 60 and thus the connectors 75*a*-75*b* remain stationary and the displacement and, therefore, the output torque of the motors 76*a*-76*d* remains constant.

If the user removes his or her foot from the accelerator 70, this causes the feedback connector 80 to move in a deceleration direction and causes the displacement control valve 60 to move toward the position 60*c*. High pressure fluid from the conduit 62 will flow through the ports on the displacement control valve 60, increasing the pressure in the conduit 68 and flowing to the cylinders 74*a*-74*d*. Since the pressure in the conduit 68 will be greater than the pressure in the conduit 66, the connectors 75*a*-75*d* will be moved in a deceleration direction, decreasing the displacement and, therefore, the output torque of the motors 76*a*-76*d*.

Advantageously, there is no direct connection between the accelerator 70 and the engine 12. Rather, the engine 12 is operated and controlled based on a combination of engine speed (based on the signal on the line 42), torque (based on the position of the displacement control valve 60, which is affected by the position of the accelerator 70), and system pressure (based on the signal on the line 38*a*). This combination of inputs allows the throttle control module 40 of the system 10 to always run the engine 12 at its peak efficiency, based on known engine efficiency parameters and, therefore, provide proportional control of the engine 12 and system 10. At times when the system 10 is fully charged, the engine 12 can be advantageously turned off, reducing the instant fuel consumption to zero. When the system pressure drops, the engine 12 is restarted to again provide pressure to the conduit 20.

Based on the condition or operating state of the air conditioning compressor 24, the power maintenance module 28, and the accumulator 38 (as determined by their respective signals on the lines 24*a*, 28*a*, and 38*a*), the throttle control module 40 sends a signal on the line 42 to start or stop the engine 12 and/or vary the displacement of the pump/motor 16.

As the system pressure in the conduit 20 increases, the accumulator 38 fills and the rate of flow from the pump/motor 16 is reduced. The flow of the pump/motor 16 continues to be reduced until the system pressure drops due to an output to the motors 76*a*-76*d*. If at any time the flow of the pump/motor 16 reaches zero flow, the engine 12 may be turned off until flow is again needed.

The flow of the pump/motor 16 may also be reduced if an accessory requires power to prevent the engine 12 from stalling (assuming the accessory is clutched to the engine 12). The powertrain system 10 obtains its efficiency by averaging the rate of power consumption. Energy needed for intermittent bursts is supplied by the stored energy in the accumulator 38. The pump/motor 16 provides flow greater than the average flow needed to propel the vehicle. The extra flow created by the pump 16 is then stored in the accumulator 38.

The hydraulic hybrid powertrain system 10 in accordance with the present invention advantageously providing an uncomplicated and straightforward control methodology and a very responsive control means for the system 10 by virtue of the fact that output torque response from the motors 76*a*-76*d*, once their displacement is increased, is very quick.

Those skilled in the art will appreciate that the system 10 in accordance with the present invention may be utilized to supply hydraulic power to any number of systems including, but not limited to, a propulsion system for a floating or submersible vessel such as a ship, a boat, or a submarine, a propulsion system for a helicopter, among others. In short, the output of the pump/motor 16 could be utilized with the powertrain system 10 to run any number of hydraulic motors, such as the motors 76*a*-76*d* for any number of purposes while remaining with the scope of the present invention.

The connectors 73, 75*a*-75*d*, and 80, and the signals on the lines 24*a*, 28*a*, 38*a*, and 42 may be any type of mechanical connector, such as a hydraulic line, a cable, a metal bar or the like, or an electrical signal communicating with solenoid valves or the like, while remaining within the scope of the present invention.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A telescoping pump/motor comprising:

a rotatable first gear having first teeth;

a rotatable second gear having second teeth, said first teeth, engaging said second teeth and said second gear being axially moveable relative to said first gear to vary a displacement of the pump/motor, one of said first gear and said second gear having a wear lobe; and a wear compensator assembly including a spring assembly, said wear lobe contacting said wear compensator and wherein said spring assembly applies a pressure to said one of said first gear and said second gear having said wear lobe to maintain a seal for pressured fluid within the telescoping pump/motor during operation and wherein said wear lobe reduces wear while maintaining fluid pressure.

2. The telescoping pump/motor of claim 1 wherein said spring assembly comprises a mechanical spring.

3. The telescoping pump/motor of claim 1 wherein said spring assembly comprises a gas spring.

4. The telescoping pump/motor of claim 1 wherein said spring assembly comprises at least one washer engaged with a bolt.

5. The telescoping pump/motor of claim 1 wherein said first gear is a ring gear having said wear lobe formed at one end and contacting a surface of a seal housing.

6. The telescoping pump/motor of claim 5 including a pressure plate abutting an opposite end of said ring gear and wherein said spring assembly comprises at least one washer engaged with a bolt, said bolt connecting said seal housing to said pressure plate to maintain the seal.

7. The telescoping pump/motor of claim 5 wherein said ring gear includes a seal ring forming a continuous sealing surface at a periphery of said ring gear.

8. The telescoping pump/motor of claim 1 wherein said second gear is a spur gear having said wear lobe formed at one end.

9. The telescoping pump/motor of claim 8 wherein said spur gear includes a seal ring forming a continuous sealing surface at a periphery of said spur gear.

10. A telescoping pump/motor comprising:

a wear compensator assembly including a wear plate and a spring assembly;

a spur gear seal abutting said wear plate; and an axially movable spur gear having teeth and a wear lobe, said spur gear telescopically engaging said spur gear seal to vary a displacement of the pump/motor, said spur gear including a seal ring forming a continuous sealing surface, wherein said seal ring is a narrow band extending along a periphery of said spur gear.

11. The telescoping pump/motor of claim 10 wherein said spur gear has a drain path for guiding fluid between said seal ring and said wear lobe.

12. A telescoping pump/motor comprising:

a wear compensator assembly including a wear plate and a spring assembly;

a seal housing abutting said wear plate;

a pressure plate coupled to said seal housing by said spring assembly; and a ring gear having teeth and a wear lobe, said ring gear positioned between said seal housing and said pressure plate, said ring gear including a seal ring forming a continuous sealing surface, wherein said seal ring is a narrow band extending along a periphery of said ring gear.

13. The telescoping pump/motor of claim 12 wherein said ring gear has a drain path for guiding fluid between said seal ring and said wear lobe.

14. A telescoping pump/motor comprising:

a rotatable ring gear having first teeth and a wear lobe;

a rotatable spur gear having second teeth and a wear lobe, said first teeth engaging said second teeth and said spur gear being axially moveable relative to said ring gear;

a first wear compensator assembly including a wear plate and a first spring assembly;

a spur gear seal abutting said wear plate, said spur gear telescopically engaging said spur gear seal to vary a displacement of the pump/motor, said spur gear including a seal ring forming a continuous sealing surface, wherein said seal ring is a narrow band extending along a periphery of said spur gear;

a second wear compensator assembly including a second spring assembly;

a seal housing connected to said wear plate by said first spring assembly;

a pressure plate coupled to said seal housing by said second spring assembly; and said ring gear positioned between said seal housing and said pressure plate, said ring gear including a seal ring forming a continuous sealing surface, wherein said seal ring is a narrow band extending along a periphery of said ring gear, said first and second spring assemblies maintaining a seal against pressured fluid at said sealing surfaces.

* * * * *